US006179675B1

(12) United States Patent
Godoy

(10) Patent No.: US 6,179,675 B1
(45) Date of Patent: Jan. 30, 2001

(54) SWIMMING FIN AND MANUFACTURE PROCESS THEREOF

(75) Inventor: Carlos Alberto Godoy, Genoa (IT)

(73) Assignee: Cressi-Sub S.p.A., Genoa (IT)

( * ) Notice: Under 35 U.S.C. 154(b), the term of this patent shall be extended for 0 days.

(21) Appl. No.: 09/391,602

(22) Filed: Sep. 8, 1999

(30) Foreign Application Priority Data

Sep. 10, 1998 (IT) ..... FI98A0206

(51) Int. Cl.[7] ..... A63B 31/08
(52) U.S. Cl. ..... 441/64
(58) Field of Search ..... 441/61, 64

(56) References Cited

U.S. PATENT DOCUMENTS

D. 350,801 * 9/1994 Dagnino ..... D21/239
D. 421,474 * 3/2000 Godoy ..... D21/806
4,795,385 * 1/1989 Matsuoka ..... 441/64
5,292,811 * 3/1994 Murata et al. ..... 525/193
5,358,439 * 10/1994 Paolo ..... 441/64
5,522,748 6/1996 Cressi ..... 441/64

* cited by examiner

*Primary Examiner*—Sherman Basinger
(74) *Attorney, Agent, or Firm*—Browdy and Neimark

(57) ABSTRACT

A swimming fin comprising a blade (1) in a relatively stiff material extending from a shoe (7) of incomplete development at the rear in a relatively soft material and a strap (6) of adjustable length connected to the shoe for wrapping at the rear the foot of the swimmer. From the rear side of the blade there extends a concave sole (2), the shoe (7) being connected to the top face thereof, and to the sides thereof flaps (4) extend to which the ends of the strap (6) are connected. The swimming fin further comprises a longitudinal strip (11), in a material of intermediate stiffness between that of the blade and that of the shoe, extending along the top face of the blade (1) and above the shoe (7) to connect the blade and the shoe therebetween.

17 Claims, 3 Drawing Sheets

SWIMMING FIN AND MANUFACTURE PROCESS THEREOF

FIELD OF THE INVENTION

The present invention relates to the field of the swimming accessories, in particular it has as its object a fin structure of the type consisting of several components of different stiffness molded in a sequence and superimposed.

DESCRIPTION OF THE PRIOR ART

Concerning the characteristics of stiffness, it is known that swimming fins have to satisfy two substantially contrasting requirements. In fact, if on one hand the blade has to be very stiff to ensure a thrust as effective as possible, on the other hand it is desirable that the shoe area, i.e. the part housing the foot of the swimmer, be sufficiently soft and flexible so as to ensure a suitable ease of use thereof. The mere use of two different materials for the blade and for the shoe does not solve the problem, as it is through the shoe, of a softer material, that the swimmer applies to the blade the forces generating the propulsive effect, therefore the fin structure has to be apt to allow an efficient transmission of said forces.

According to the U.S. Pat. No. 5,522,748, the problem is solved by a swimming fin consisting of three members molded in a sequence and superimposed, i.e. a blade, a connection member and a shoe, in a decreasing order of stiffness. The connection member comprises a substantially curved portion for wrapping the shoe, and a fork-shaped portion for embracing the two side edges of the blade. To ease the transmission of the propulsive motion from the foot to the blade, the latter is provided with a downwardly bent, flat rear portion, onto which first the curved portion of the connection member and then the shoe are molded in a sequence.

However, the swimming fin hereto described foresees wraparound shoes of different sizes, allowing no footwear adjustments after the selection of the best fitting size. In most uses of a swimming fin this limitation is not a drawback, provided there has been a correct selection of the shoe sizes.

Nevertheless, for some performances, mainly in sports, the possibility of adjusting the tightness of the footwear is desirable in order to enable the swimmer to use the swimming fin in a graduated manner, using it depending on the kind of effort required by the pace and, in general, on the specific activity performed by the swimmer with the aid of the swimming fins. The adjustment can be made viable by means of an incompletely developed shoe, i.e. lacking the rear portion that is replaced by a strap provided with a buckle apt to adjust the length thereof.

However, making the foot of the swimmer integral to the swimming fin is more difficult in a swimming fin provided with an adjustable strap, as compared to a swimming fin provided with a wraparound shoe. In fact, even with a structure of the above-described type, the two points of the blade to which the strap ends are secured constitute of necessity pivot points that increase the degrees of freedom of the foot with respect to the fin, and limit the possible directions of transmission of the required force to the fin.

SUMMARY OF THE INVENTION

The object of the present invention is to overcome these limitations, by providing a swimming fin that combines the advantages of the swimming fins provided with a wraparound shoe to those of the swimming fins provided with an adjustment strap.

Such object is attained by means of the swimming fin according to the present invention, that comprises a blade in a relatively stiff material, extending from a shoe having a partial development on the rear thereof performed in a relatively soft material, and a strap of adjustable length connected to said shoe for wrapping at the rear the foot of the swimmer. A generically hollow sole extends from the rear side of said blade, said shoe being connected onto the top face thereof, and respective connection members extending from the sides thereof to the ends of said adjustable strap, said swimming fin further comprising a longitudinal strip, in a material of intermediate stiffness with respect to those of said blade and of said shoe, located along the top face of said blade and extending up to above said shoe to connect at the top said blade and said shoe therebetween.

According to the invention, a manufacturing process of the swimming fin of the above-mentioned type, is also described.

BRIEF DESCRIPTION OF THE DRAWINGS

Characteristics and advantages of the swimming fin and of the molding process thereof according to the present invention will be evident in the following description of one embodiment thereof, given as a non-limiting example, with reference to the annexed drawings, wherein.

DESCRIPTION OF THE PREFERRED EMBODIMENT

Figure 2:
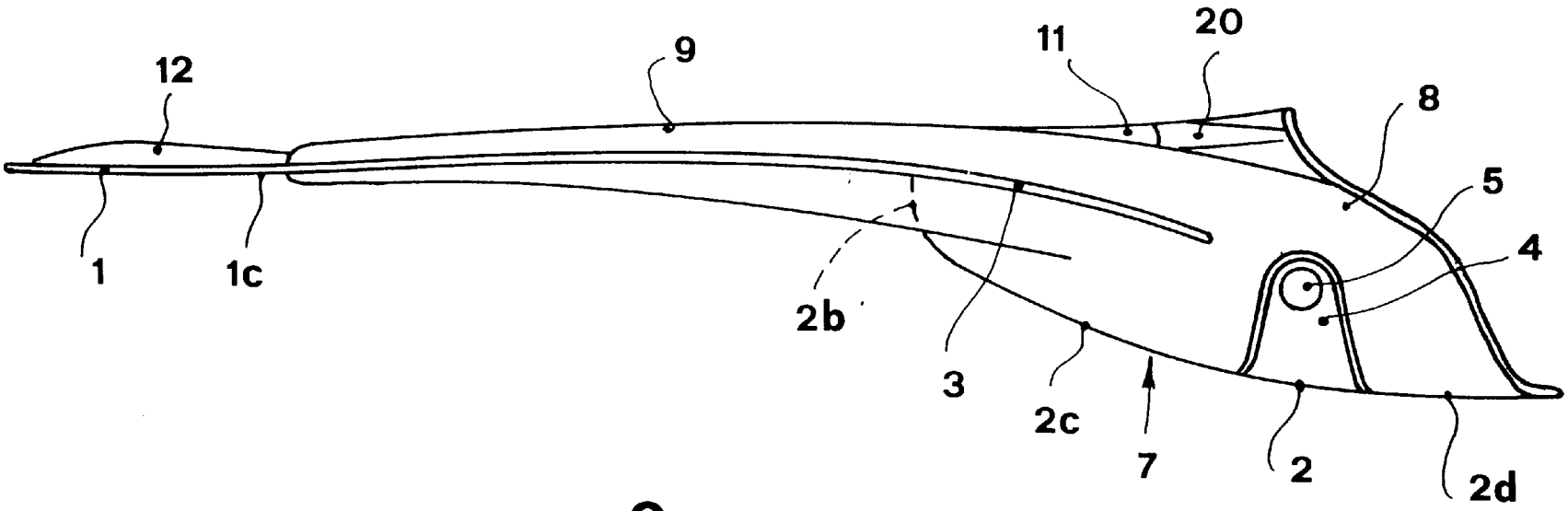
FIG. 2 is a side view of the fin of FIG. 1.
Figure 3:
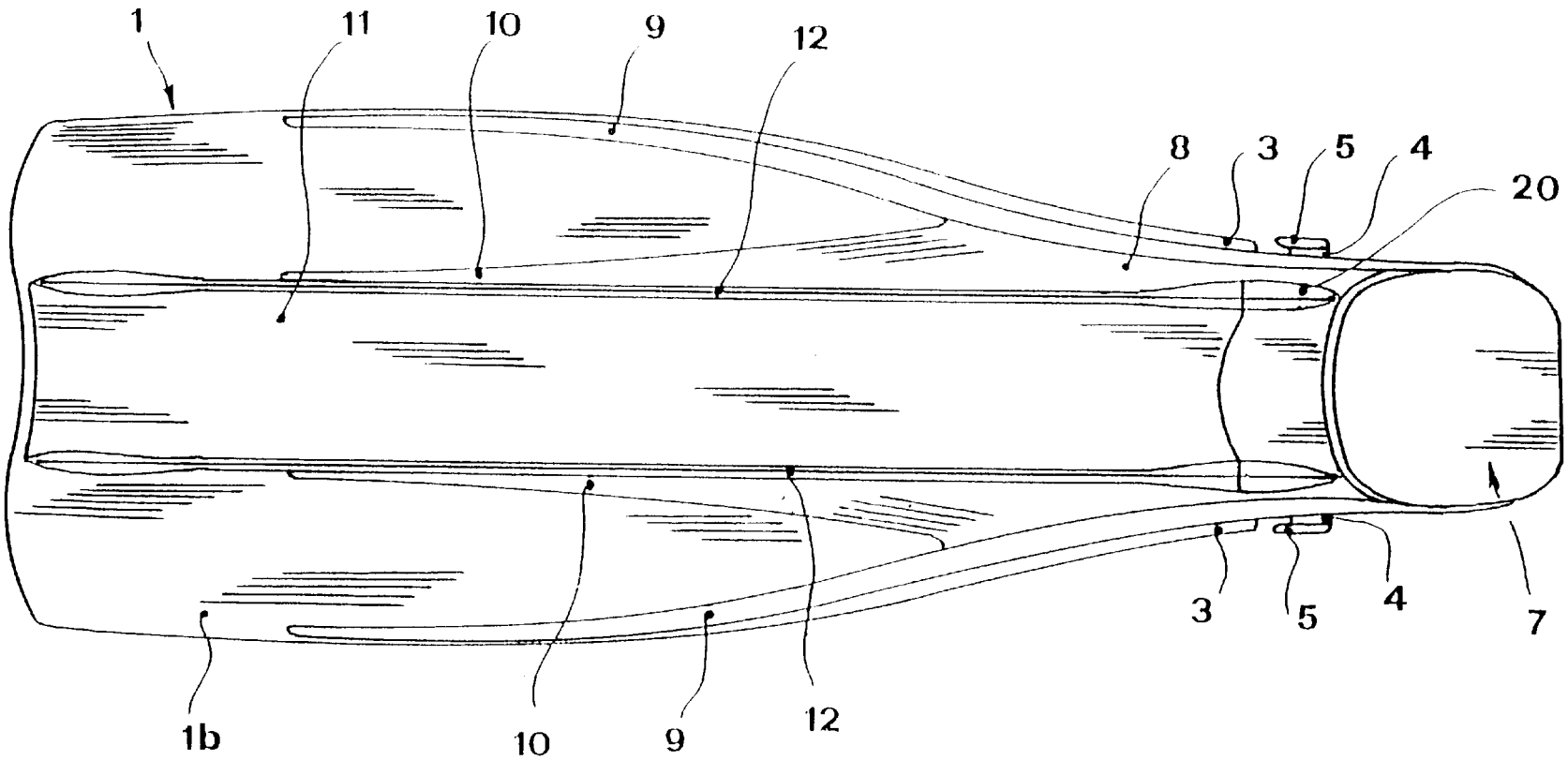
FIG. 3 is a top plan view of the fin of FIG. 1.

With reference to the above figures, a substantially flat fin blade, made of a relatively stiff material and having a conventional longitudinal development, is indicated with 1. A sole 2 integrally extends from the rear side of blade 1, in a central position and in a substantially longitudinal direction. Sole 2 is generically hollow at the side of the top face 1*b* of blade 1, where the term top, as well as bottom, front, rear and the like hereinafter used refers to the fin as it is worn by a swimmer standing on the ground, i.e. as it is shown in FIGS. 2 and 3. Moreover, longitudinal wings 3, likewise integral to blade 1, extend from respective ends of rear side 1*a*. In the present embodiment, in particular as it is apparent in FIG. 2, the sole 2 is advantageously provided with a front portion 2*b* markedly slanted with respect to the plane of blade 1, an intermediate portion 2*c* slightly slanted with respect to the same plane, and a rear portion 2*d* substantially parallel thereto.

Figure 1:
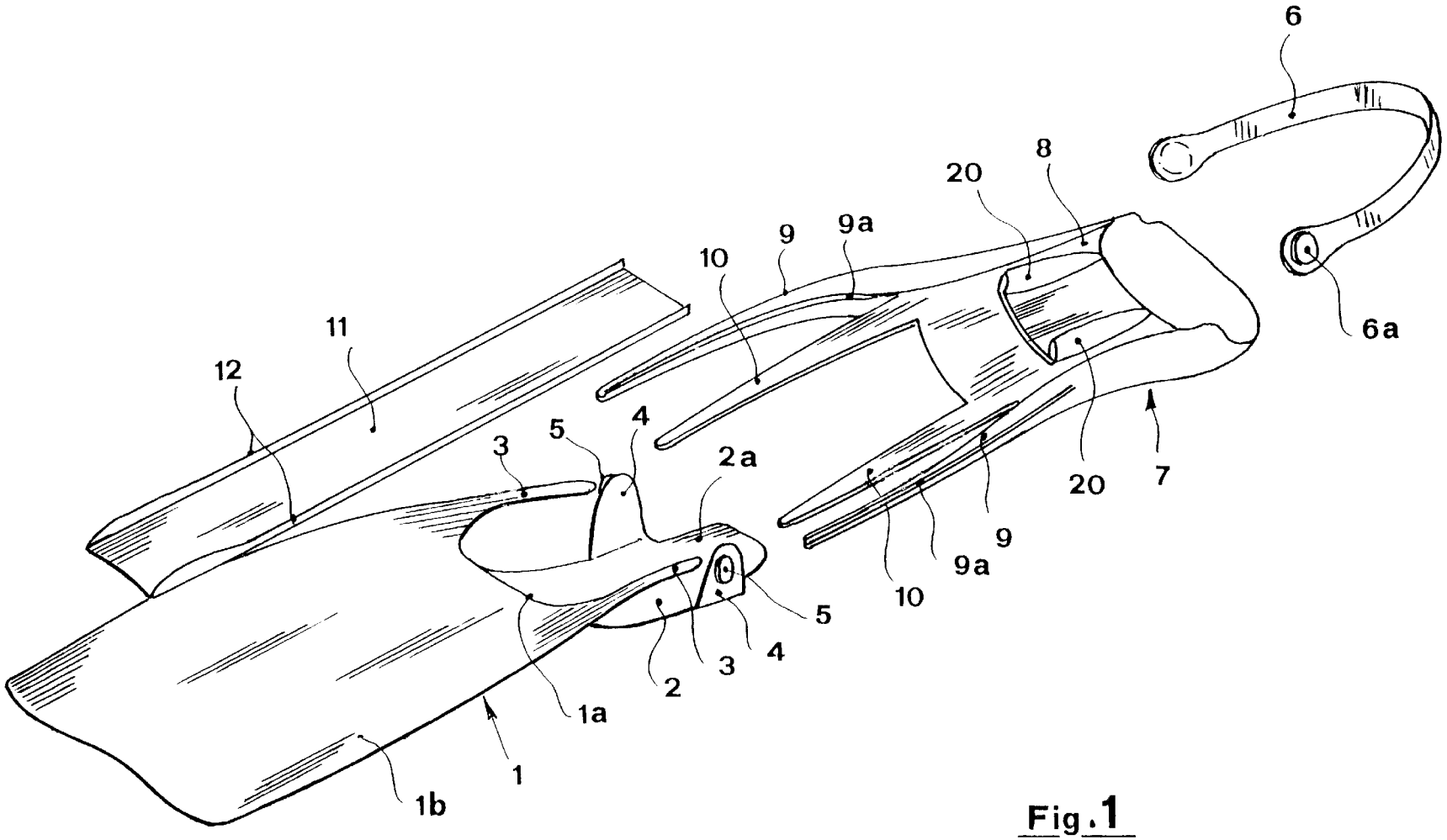
FIG. 1 is an exploded perspective view of the fin according to the invention.

A flap 4 extends from each side of sole 2, at the top face 2*a* thereof, for connecting an adjustable strap 6, schematically shown in FIG. 1 only, to blade 1 through sole 2 itself. In particular, flaps 4 externally support respective pins 5, for engaging within end slots 6*a* formed in the strap 6, and more precisely within the body of an adjustment buckle of conventional type, not shown.

The fin further comprises a partially developed shoe 7, of a relatively soft and flexible, elastic material, substantially consisting of a tubular body 8 connected to the top face 2*a* of sole 2 so as to be apt to wrap the front and the median portion of the foot of the swimmer. Two outer connection arms 9 of curved development extend longitudinally and symmetrically from the front portion of body 8 of shoe 7, that connect to blade 1 along the side edges thereof, and along the two wings 3 constituting the extension of the latter.

In particular, each of the two arms 9 has a longitudinal slot 9*a,* of a height equal to the thickness of the blade 1, housing the edge and the respective wing 3 thereof, so that the two arms 9 form a protrusion extending upwardly and downwardly of blade 1.

Furthermore, two inner connection arms 10 extend in a substantially parallel manner from shoe body 8, that connect to the top face 1*b* of blade 1.

Lastly, a flat strip 11 in a material of a stiffness intermediate between those of blade 1 and of the shoe 7 is connected along the top face 1*b* of the blade 1 between the two inner connection arms 10, extending up to above body 8 of shoe 7, so that the latter is wedged between sole 2 and flat strip 11. Strip 11 is delimited by two longitudinal ribs 12 bulging at the ends. The two bulging ends located at an end of strip 11 abuts against corresponding upwardly extending projections 20, formed on body 8 of shoe 7.

According to the present invention shoe 7, although of a relatively yielding material, enables the swimmer to apply increased forces to the blade. This is due in the first place to the fact that the connection between adjustable strap 6 and blade 1 is performed through stiff members, like flaps 4, integral to blade 1 itself. Furthermore, the swimmer foot is wedged between blade 1 and superimposed flat strip 11, both relatively stiff. However, they can elastically open out, offering a controlled yielding to the foot and relieving the effort made by the foot.

As shown in particular in FIG. 2, pins 5 for connection between blade and end slots 6*a* of adjustable strap 6 lie in an intermediate position between sole 2 and flat strip 11, i.e. the stiffer parts of the fin, whereby the clamping of strap 6 pushes the foot of the swimmer inside shoe 7, substantially with the same wrapping effect obtainable by means of a wraparound shoe.

Moreover, it has to be pointed out that advantageously flaps 4 extend up to about one third of the longitudinal development of sole 2 starting from the rear end thereof, so that the ends of strap 6 are fastened forwardly with respect to the heel of the swimmer. Thus, the fastness of the footwear, and therefore its capability of transmitting the efforts to the blade, is really comparable to that obtainable with fins provided with a completely developed shoe. Further, the shown shape of sole 2 causes the foot of the swimmer to be completely below blade 1, which, having no top projections, yields a remarkable increase in the propulsive efficiency.

The production of the blade according to the invention requires a specific manufacture process of molding, foreseeing three steps in sequence: molding blade 1, then molding flat strip 11 longitudinally onto top face 1*b* of the blade, so that a portion of said strip protrudes from rear side 1*b* of the blade; then shoe 7 is molded onto sole 2 in such a manner that the protruding portion of strip 11 be superimposed and connected to body 8 of shoe 7, with the bulging ends of ribs 12 aligned and mated to projections 20 of body 8. Remarkably, in particular when shoe 7 is molded so as to make body 8 thereof integral to top face 2*a* of hollow sole 2, arms 9 and 10 are connected to the side edges of blade 1 and to top face 1*b* thereof along the strip 11, respectively.

As for the materials to use, advantageously in the first step of the molding process a mix of elastomerized polyolefin compounds apt to make a fin blade 1 of relatively high stiffness can be used, whereas thermoplastic elastomer-based compounds are used in different ratios in the second and the third step, i.e. for the molding of the shoe and of the strip.

Whereas the above materials are essentially of a type known to a person skilled in the art and available on the market, however hereinafter some specifications useful in the selection thereof are provided by way of indication.

| Material For | Density g/cc | Modulus of elasticity N/mm2 | Tensile strength N/mm2 | Hardness |
|---|---|---|---|---|
| Blade | 0.9 | 1000–1500 | 20–30 | 80–100 (Rockwell) |
| Strip | 1–1.2 | 4(1) | 5–10 | 80–100 (Shore A) |
| Shoe | 1–1.2 | 0.8–1.2(1) | 3–8 | 25–50 (Shore A) |

(1)at 100% stretching

Variations and/or modifications may be brought to the swimming fin with adjustable strap and to the molding process thereof according to the present invention, without departing from the protective scope of the invention as set forth in the appended claims.

What is claimed is:

1. A swimming fin comprising a blade of a relatively rigid material, extending from a shoe having an incomplete development at the rear side and made in a relatively soft material, a strap of adjustable length connected to said shoe for wrapping at a rear of a foot of a swimmer, a concave sole extending from a rear of said blade, said shoe being connected to a top face of said sole, respective connection members extending from sides of said sole from connecting said sole to ends of said adjustable strap, said fin further comprising a longitudinal strip in a material of intermediate stiffness with respect to those of said blade and of said shoe, an entire width of the longitudinal strip extending above and engaged to both a top face of said blade and to a top face of said shoe to connect said shoe between the longitudinal strip and said sole.

2. The swimming fin according to claim 1, wherein said shoe comprises a substantially tubular body, connected to said sole, from which longitudinal arms forwardly extend, for connecting said shoe to the edges and the top face of said blade.

3. The swimming fin according to claim 2, wherein said blade has two wings extending symmetrically from its side edges toward said shoe, said longitudinal arms comprising a pair of outer connection arms and a pair of inner connection arms, said pair of outer connection arms being connected to said blade along side edges thereof and to the wings extending therefrom.

4. The swimming fin according to claim 3, wherein said outer connection arms form a protrusion extending upwardly and downwardly from said blade.

5. The swimming fin according to claim 3, wherein said inner connection arms extend along and engage sides of said longitudinal strip.

6. The swimming fin according to claim 3, wherein said connection members comprise flaps extending from the top face of said sole and supporting pins for engaging within respective slots at the ends of said strap.

7. The swimming fin according to claim 6, wherein said flaps are located at about one third of the length of said sole starting from the rear end thereof.

8. The swimming fin according to claim 7, wherein said sole comprises a front part markedly slanted with respect to the lying plane of said blade, an intermediate part slightly slanted with respect to said plane and a rear portion substantially parallel thereto.

9. The swimming fin according to claim 8, wherein the height of said flaps with respect to said sole is such that said pins for the connection to said strap ends are in a substantially intermediate position between said sole and said flat strip.

10. The swimming fin according to claim 1, wherein said connection members comprise flaps extending from a top face of said sole and supporting pins for engaging within respective slots at ends of said strap.

11. The swimming fin according to claim 10, wherein said flaps are located at about one third of a length of said sole starting from a rear end thereof.

12. The swimming fin according to claim 10, wherein a height of said flaps with respect to said sole is such that said pins for the connection to said strap ends are in a substantially intermediate position between said sole and said longitudinal strip.

13. The swimming fin according to claim 1, wherein said sole comprises a front part markedly slanted with respect to a lying plane of said blade, an intermediate part slightly slanted with respect to said plane and a rear portion substantially parallel thereto.

14. The manufacture process of a swimming fin according to claim 1, characterized in that it comprises the following steps:

molding the blade in a relatively stiff material, comprising a concave sole extending from the rear end of said blade, from the sides of said sole there extending respective connection members of said blade to ends of an adjustment strap;

molding a flat strip longitudinally connected to a top face of said blade and extending from a rear side thereof over said sole;

molding the shoe opened at the rear connected to said sole and to the extended portion of said strip; the material of said shoe being relatively soft and the material of said strip being of an intermediate stiffness between that of said blade and that of said shoe.

15. The process according to claim 14, wherein the material to make said blade is an elastomerized polyolefin mix, whereas the material to make said strip and said shoe is a thermoplastic elastomer-based mix.

16. The process according to claim 15, wherein said elastomerized polyolefin mix has a Rockwell hardness of 80–100.

17. The process according to claim 15, wherein said thermoplastic elastomer-based material has a Shore A hardness of 25–50 for the shoe and of 80–100 for the strip, respectively.

* * * * *